United States Patent [19]

Sabol, Jr. et al.

[11] Patent Number: 4,842,762

[45] Date of Patent: Jun. 27, 1989

[54] LAUNDRY SOIL AND STAIN REMOVER IN APPLICATOR STICK FORM

[75] Inventors: John S. Sabol, Jr., Indianapolis; Wayne A. Kester, Whitestown, both of Ind.

[73] Assignee: The Dow Chemical Company, Midland, Mich.

[21] Appl. No.: 119,866

[22] Filed: Nov. 13, 1987

Related U.S. Application Data

[63] Continuation-in-part of Ser. No. 851,857, Apr. 14, 1986, abandoned, which is a continuation-in-part of Ser. No. 742,627, Jun. 7, 1985, abandoned.

[30] Foreign Application Priority Data

| | | | |
|---|---|---|---|
| Feb. 6, 1986 | [EP] | European Pat. Off. | 86107435 |
| May 6, 1986 | [AU] | Australia | 56374/86 |
| Jun. 6, 1986 | [AR] | Argentina | 304270 |
| Jun. 6, 1986 | [CA] | Canada | 510966 |
| Jun. 6, 1986 | [CO] | Colombia | 256980 |
| Sep. 6, 1986 | [BR] | Brazil | 8602804 |

[51] Int. Cl.[4] ..... C11D 3/386; C11D 3/04; C11D 9/60; C11D 17/00

[52] U.S. Cl. ..... 252/109; 252/90; 252/110; 252/121; 252/134; 252/135; 252/174; 252/174.12; 252/539; 252/DIG. 12; 252/DIG. 16; 424/DIG. 5

[58] Field of Search ..... 424/DIG. 5, 76.3; 252/174.12, 134, DIG. 12, 135, 90, 121, 174, DIG. 16, 109, 110, 539

[56] References Cited

U.S. PATENT DOCUMENTS

| | | | |
|---|---|---|---|
| 3,519,570 | 7/1970 | McCarty et al. | 252/135 |
| 3,664,962 | 5/1972 | Kelly et al. | 252/125 |
| 3,697,451 | 10/1972 | Mausner et al. | 252/174.12 |
| 3,798,181 | 3/1974 | Vazquez | 252/174 |
| 3,843,528 | 10/1974 | Bailey et al. | 252/18 |
| 3,860,536 | 1/1975 | Landwerlen et al. | 252/551 |
| 3,953,352 | 4/1976 | Barret, Jr. et al. | 252/174 |
| 3,953,353 | 4/1976 | Barrett, Jr. et al. | 252/174 |
| 4,269,723 | 5/1981 | Barford et al. | 252/174 |
| 4,322,400 | 3/1982 | Yuhas | 424/DIG. 5 |
| 4,396,521 | 8/1983 | Borrello | 252/118 |
| 4,396,522 | 8/1983 | Callicott et al. | 252/170 |
| 4,534,879 | 8/1985 | Iding et al. | 252/174 |
| 4,661,452 | 4/1987 | Markussen et al. | 252/174.12 |

OTHER PUBLICATIONS

Robertson, W. S. (editor) *Lubrication in Prachie,* 2nd ed. Marcel Decker, Publisher N.Y. p. 161.

*Primary Examiner*—Paul Lieberman
*Assistant Examiner*—Linda D. Skaling

[57] ABSTRACT

A prelaundering composition in solid, stick-like form to be applied by direct contacting of a fabric as soiled and stained zones thereof to transfer the solid product to the areas to be treated. The product includes a surfactant and laundry enzymes homogeneously dispersed throughout a semi-hard carrier vehicle including in-situ formed sodium stearate. Various salts added to the composition of the invention as effective selectively to modify, controllably and independently, particular physical and chemical parameters of the composition, including texture, consistency, hardness, melting point and pH to optimize the rheology and the softening range of the product and to enhance related functional features.

8 Claims, 1 Drawing Sheet

LAUNDRY SOIL AND STAIN REMOVER IN APPLICATOR STICK FORM

This is a continuation in part application of co-pending application Ser. No. 06/851,857 filed Apr. 14, 1986, now abandoned which is in turn a continuation in part of application Ser. No. 06/742,627 filed June 7, 1985 now abandoned.

BACKGROUND OF THE INVENTION

The present invention relates to a solid type fabric-cleaning product which finds utility as a pre-applied spotting agent used prior to a laundering procedure so as to facilitate the removal of stains and soil from selected pre-treated areas of the fabric. More particularly, the invention is directed to a laundry soil and stain removing composition which includes, in combination, surfactants, laundry enzymes, and a carrier material so as to provide a solid medium that can be applied conveniently to a fabric as an aid in laundering. The composition includes a chemical agent for regulating and for selectively, independently modifying physical and chemical parameters of the product to enhance its functional features and its effectiveness in use.

Compositions finding utility as pre-spotting preparations have long been utilized in the laundering and cleaning field. Such preparations have been applied to particular, selected stained or excessively soiled areas of clothing and other fabrics prior to subjecting the pre-treated material to a laundering operation. It has been established that effective pre-treatment of the type described increases the likelihood of removing the soils and stains effectively.

The specialized preparations of the prior art have taken various physical forms and have embraced a broad variety of chemical formulations. Among such pre-treatment preparations are dry products which have ordinarily been used in conjunction with water to provide a solution in which the fabric to be cleaned is subjected to a pre-soaking step. Other prior products include formulations packaged for spraying from aerosol type dispensers or from bottles fitted with pump mechanisms. Still other specialized preparations constitute preparations which are applied, as liquid pre-spotters, directly to the area to be treated.

Some of the products of the type referred to above have included laundry enzymes of the type which have been demonstrated to act effectively to enhance the removal of foreign material including oil and grease stains and other stains and soil from fabrics. The enzymes system employed are critically sensitive to the pH of the system into which they are introduced. This fact has interfered with and impaired their use in laundry preparations.

The use of dry powders in conjunction with water is inconvenient, as is the use of liquid pre-spotters. Aerosol type pre-spotting preparations are costly and suffer the disadvantages inherent in all aerosol type products.

Another shortcoming of prior art "stain sticks" or pre-spotters, particularly those using a sodium stearate matrix is that it has heretofore not been possible to formulate a product which is soft but which also has a dropping point above 120° F., a temperature reasonably to be encountered during shipment or warehouse storage.

Many of the products heretofore produced have failed to achieve a balance and functional optimization of the values of interrelated parameters including pH, drop point, and hardness which define and determine the utility and the effectiveness of laundry pre-spotting preparations.

It is also known in the prior art to utilize pre-spotters which take the physical form of stick-like probes or applicators. It is to the improvement of the latter type of product and to the elimination of shortcomings and inadequacies of prior art products that the present invention is directed.

SUMMARY OF THE INVENTION

It is a principal object of the present invention to provide a laundry soil and stain remover composition which takes the physical form of an applicator stick with improved physical and chemical properties and which may conveniently be used contactingly to apply preferred spot removing and stain removing formulations of the invention to selected areas of fabric, prior to subjecting the fabric to a laundering operation.

It is an important feature of the stain removing compositions of the invention that they include, in combination, a surfactant, and in preferred embodiments, a surfactant system containing both non-ionic and anionic surfactants, one or more laundry enzymes, a bodying agent in which the enzymes and the surfactant are homogeneously distributed, and a chemical agent for selectively, controllably and independently modifying the value of one or more physical and chemical parameters of the composition to enhance its operation.

It is a related feature of the invention that the preferred formulations of the invention have proven exceedingly effective to remove stains and soil from cotton fabrics as well as from "synthetics".

A most important feature of the invention is the incorporation of a salt into the composition in a critical concentrational range, so as effectively and selectively to modify a given specific parameter of the product thereby to improve both its physical and its chemical properties and to render the cleaning preparation more useful in its intended applications.

A feature of the invention is the discovery that there are critical relationships between the several distinct components of the compositions of the invention and that the concentrations of the components, particularly that of the salt, significantly affect the rheology and other properties, including the "dropping point" or drop point of the product.

Yet another feature of the invention is that the method of preparing the compositions of the invention includes the step of forming sodium stearate, in-situ, one benefit of this procedure being a significantly reduced cost for raw materials.

It is an important practical advantage of the formulations of the invention that they may be applied as much as several days before subjecting the treated fabric to laundering, with no adverse effects. (The requirement in prior art products that the fabrics so treated must be subjected to washing immediately and the applied pre-spotter not be allowed to dry, has been obviated).

In accordance with the present invention the physical properties including the hardness of the final product are effectively controlled by adding a critical concentration of salt to the matrix to control the consistency of the product as well as to maintain the dropping point about 120° F. The present invention provides a simple and highly effective way to raise the dropping point while at the same time decreasing the hardness of the product.

It is an important pratical feature of the formulations of the invention that they have been found to function effectively in removing a broad spectrum of stains including milk, blood, ink, cocoa, and sugar, as well as grass soils, on cotton and synthetics.

The formulations of the present invention provide stick applicators which have the requisite physical strength in combination with the property of being soft enough to be transferred mechanically to the areas to be treated, so that the product may be readily handled and used conveniently, and effectively, and, at the same time, maintaining a physically stable form at the elevated temperatures to which such products are exposed during shipment and storage.

Other and further features, objects, and advantages of the compositions of the invention will be evident from the following description considered in conjunction with the claims and with the drawing.

DESCRIPTION OF PREFERRED EMBODIMENTS

Figure 1:
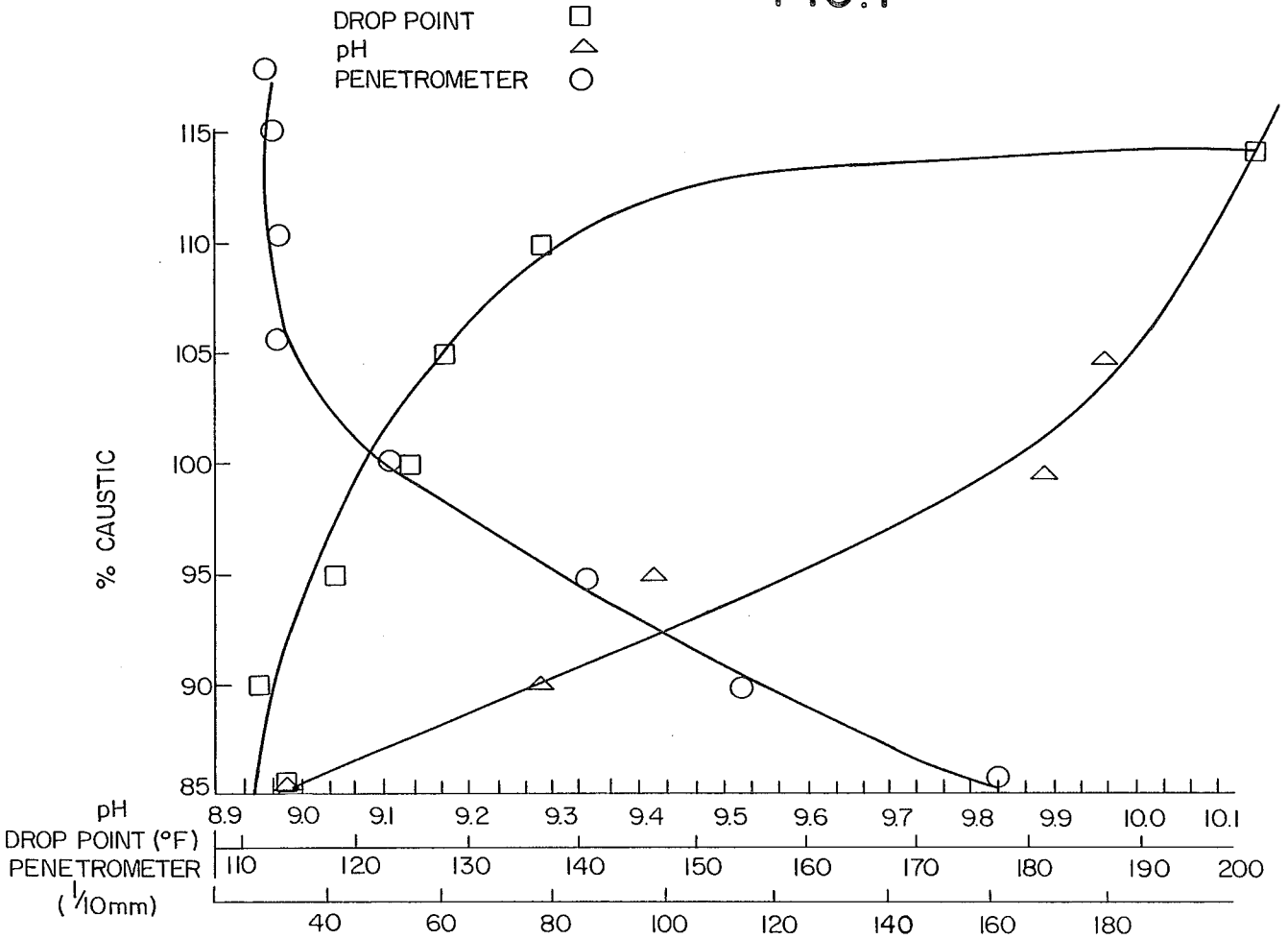
FIG. 1 of the drawing is a graphic representation illustrating the inter-relationship between various parameters, including drop point, pH and hardness, of relevance to the present invention, and indicating the relation of each to caustic concentration.

In preferred embodiments, the aims and objects of the present invention are achieved by formulating a highly effective and versatile cleaning concentrate in the form of a readily manipulable stick-like probe or applicator which includes, in combination, inorganic and organic salts, an enzyme system, a surfactant, the salts, enzymes, and the surfactant being uniformly and homogeneously distributed throughout a supporting matrix or carrier to provide a relatively soft but readily handled rod facilitating the direct application of the composition to selected areas of fabric to be treated. The physical consistency, hardness, softening temperature and the general rheology of the matrix of the product are controlled and adjusted through the addition of the salt or salts, within well defined concentrational limits.

The compositions of the invention exhibit the requisite values of parameters including adequate rigidity, strength, hardness and temperature sensitivity and stability as well as requisite physical transferability, upon abrasive contact, to the fabric to which the composition is to be applied. Additionally, chemical properties, including the pH, are controlled to ensure an environment in which the enzymes present in the product can perform effectively.

The present invention invokes a unique combination of a system of laundry enzymes in conjunction with, preferably, two or more different types of detergents which augment and supplement one another, all contained as intimately and homogeneously dispersed elements in a carrier medium which includes added salt or salts in critical concentrations to provide control over those physical properties and characteristics which ensure stability in shipment and storage and which also makes it easy to handle the product physically and to apply the composition of the invention to selected areas which have been delineated for pre-treatment in advance of a laundering operation.

Preferred formulations of the laundry soil and stain remover products of the invention include, as fluid components or solvents in the matrix system, propylene glycol and dipropylene glycol and mixtures of the two. In accordance with the practice of the present invention, the relative ratio and concentrations of the glycols may be selected to alter and define the rheology of the matrix. The dimer produces a harder matrix than does propylene glycol, and the trimer, even harder products. The glyols can be blended to produce products with desired rheological properties.

In formulations of the type referred to, salts, particularly borate and formate salts (e.g., sodium borate decahydrate) were added for the purpose of enhancing enzyme stability. In the course of this research, the surprising and unexpected discovery was made that these salts and other organic and inorganic salts could be used to control the consistency of the matrix of the product. Upon further research in this area of investigation it was discovered that the value of other important parameters, for example, temperature sensitivity, of the products could also be varied and controlled through the incorporation of salts in controlled concentrations. At the same time, the added salt components could be used effectively to control the pH in the formulated product.

In accordance with the practice of the present invention the addition of the salts, in a particular concentrational range is effective not only to raise the drop point and decrease the hardness of the product, but also to increase the hardness, and raise the drop point temperature without raising the pH significantly.

While hardness and drop point may be increased by using more stearic acid and more sodium hydroxide solution (50% NaOH), the concurrent effect is to increase the pH. Such increase is undesirable if there is a pH-sensitive component in the composition. For example, too elevated a pH has an adverse effect on enzyme systems. In the practice of the present invention it is practical, by the controlled addition of a salt, to produce a "harder" formulation without the objectionable side effect of elevating the pH.

In formulations of the type embodied herein, the final product is often translucent to opaque. Accordingly, there may be some difficulty seeing where the product has been applied. The color of the product may also be undesirable or may not be consistent with the color one expects for a laundry product. To correct these features, one can add traditional coloring agents to the formulations. Examples include titanium dioxide, pearlescent agents of the type traditionally used in the cosmetic and soap industry, various organic dyes of the type commonly used in laundry and detergent products, and other coloring and opacifying agents that would impart a color to the product, but which would not dye or discolor the fabric.

The traditional effect the changing of the sodium hydroxide concentration has on pH, hardness (Penetrometer reading), and drop point (temperature response) is shown in TABLE I AND FIG. 1. The 100% caustic point (Sample D in TABLE I) represents the formulation listed below (Example 1). The other data represent formulations in which the water/caustic ratio has been changed to give the desired amount of caustic. (See TABLE I).

TABLE I

| SAMPLE # | COMPOSITION | DROP Pt (°F.) | PENETR | pH |
|---|---|---|---|---|
| A | [$OH^-$] [$H_2O$] 21.85 29.65 (15% xs OH) | >200 | 29 | 10.12 |
| B | 20.90 30.60 (10% xs $OH^-$) | 136.2 | 26 | 10.09 |
| C | 19.95 31.55 (5% xs $OH^-$) | 128.3 | 33 | 9.96 |
| D | 19.00 32.5 | 124.3 | 48 | 9.89 |
| E | 18.05 33.45 (5% less $OH^-$) | 118.6 | 85 | 9.41 |
| F | 17.01 34.40 (10% less $OH^-$) | 112.2 | 115 | 9.29 |
| G | 16.2 35.35 (15% less $OH^-$) | 114.7 | 160 | 8.99 |

In formulations of the product of the invention it is desirable that the temperature sensitivity be that correlated with a dropping point reading of above about 120° F. The pH should preferably be in the range of about 9.3 to about 9.8 and optimally at about 9.5. The penetrometer reading should preferably be no less than 110 units (penetration of 11.0 mm). These values correlate with data derived from consumer testing. FIG. 1 depicts schematicly the variation and dependency as well as the inter-relationship between drop point, pH and penetrometer reading as a function of alkali concentration.

| Ingredient (gms) | Conc. |
|---|---|
| Propylene Glycol | 190.0 |
| Nonylphenol Ethoxylate | 75.7 |
| Linear Alcohol Ethoxylate | 75.7 |
| Polyethylene Glycol | 8.0 |
| Dodecylbenzenesulfonic Acid | 26.5 |
| Stearic Acid | 47.7 |
| Enzyme | 25.0 |
| Water/caustic - As shown in Table I, Sample D | |
| Drop Point | 123.4° F. |
| pH | 9.36 |
| Penetrometer Reading | 54. (5.4 mm) |

As the graph of FIG. 1 indicates, the formulation of Example 1 and other typical sodium stearate formulations will have very unique properties. The pH, hardness, and drop point are all inter-related and are unique for each given formulation. The drop point of traditional stearate formulations cannot be changed without affecting the other two characteristics (pH and hardness).

The present invention provides formulations and a method by which one can change the drop point, for example, and not affect one or both of the other two properties, that is, hardness and pH. The unique utility of the invention is evident upon a consideration of the following examples provided for illustrative purposes to show effects of controlling salt concentrations. The examples are not to be construed in any limiting sense. Examples 2, 3 and 4 compare and contrast the properties of typical sodium stearate formulations (shown in Example 1) with the improved effects achieved through the incorporation of salts in critical concentrations, in accordance with the present invention.

EXAMPLE 2

The addition of 1% sodium chloride to the composition of Example 1 gives a drop point of 130° F. a pH of 9.35, and a penetrometer reading of 50. The "comparable" sodium stearate formulation (Example 1) has a drop point of 123.4° F., a pH of 9.36, and a penetrometer reading of 54.

In the salt-modified Example 2 formulation, the drop point has been raised (130° F. from 123° F.) without significantly changing the other characteristics of the values of other input and parameters. In referring to the graph, it will be noted that a sodium stearate formulation with a raised drop point of 130° F. would have a pH of 10 and a penetrometer reading of 35. Such a formulation would be difficult to rub onto the fabric due to the hardness of the composition. Moreover, the pH would be above the optimum for an enzyme, which is generally recognized as being a pH of no higher than 9.5.

EXAMPLE 3

If one desires a product that is softer, for example, a penetrometer reading of 110, the graph of FIG. 1 indicates that the pH of this formulation would be 9.35 and the drop point would be 113° F. The pH of this formulation is within the optimum range for an enzyme, but the dropping point is below the desired minimum of 120° F. The addition of 3% sodium borate decahydrate to the formulation, for example, gives the desired product.

EXAMPLE 4

Another example of the utility of this invention is illustrated with a formulation that would be harder than the formulation illustrated in the previous two examples. If one desires a stick with a penetrometer reading of 38, the graph and FIG. 1 indicate that the stearate formulation with that hardness would have a pH of 9.9 and a drop point of 123° F. In this example, the dropping point is above the target of 120° F., but the pH is above the optimum of 9.5. The addition of 3% sodium acetate would give a stick with the desired hardness and pH.

In the development of the present invention it was discovered that the concentrational range of salts useful as additives in the laundry soil and stain remover formulations for achieving the desired values of parameters involved is from 1% to 4% by weight. The criticality of the 1-4% concentrational range for the salt component of the spotting stick of the invention was evidenced in experimental tests conducted using two principal product formulations. In a first formulation, no salt was added. In the other formulations 5% by weight salt was incorporated in the compositions.

The formulations were tested: for pH using a 1% solution in deionized water, for dropping point using a Mettler Thermosystem, and for hardness using a penetrometer with standard brass cone and a penetration time of five seconds. The sample for the penetrometer determination was poured, while molten, into a 500 milliliter plastic beaker. The formulations, with no salt, and with 5% salt are shown below:

| FORMULATION I, NO SALT ADDED | |
|---|---|
| Stearic acid | 9.50% |
| Dodecylbenzene sulfonic acid | 5.30% |
| Propylene Glycol | 38.00% |
| NP-4 Nonylphenol ethoxylate | 15.14% |
| Neodol 45-7 Linear alcohol ethoxylate | 15.14% |
| PGE-900 | 1.60% |
| NaOH-50% | 3.80% |
| Enzyme-Milezyme 300/120 | 5.00% |
| Fragrance | 0.01% |
| Water | Q.S. |

FORMULATION II, 5% SALT ADDED

-continued

| | |
|---|---|
| Stearic Acid | 9.64% |
| Dodecylbenzene sulfonic acid | 5.38% |
| Propylene Glycol | 33.68% |
| Dipropylene Glycol | 3.85% |
| NP-4 Nonylphenol ethoxylate | 13.31% |
| Neodol 45-7 Linear alcohol ethoxylate | 13.31% |
| PGE-900 | 1.63% |
| NaOH-50% | 3.85% |
| Enzyme-Milezyme 300/120 | 5.00% |
| Salt | 5.00% |
| Fragrance | 0.01% |
| Water | Q.S. |

The formulations were prepared, using the procedure of the subject patent application, by first adding all the surfactants except dodecylbenzene sulfonic acid, the PGE-900, the glycols, and heating to 135° F. When this temperature was reached, stearic acid was added and stirring continued until everything was in solution. The salt (Formulation II) was then added to the water portion, 24.55 gm, and warmed on a hot plate. The NaOH was then added, and heating continued until solution took place. This portion was added to the surfactant solution and stirring was continued. The dodecylbenzene sulfonic acid was added, with continued stirring. After the exotherm had subsided and the temperature had returned to 135° F., the enzyme and fragrance were added, the product stirred for a minute or two, and the product cast into the appropriate containers.

The following results were obtained when each of a series of representative salts was used in the above method.

| Salt Used | Observation |
|---|---|
| 5% Sodium Chloride | Insoluble |
| 5% Potassium Chloride | Insoluble |
| 5% Potassium Bromide | Insoluble |
| 5% Sodium Bromide | Insoluble |
| 5% Sodium Carbonate | Insoluble |
| 5% Sodium Acetate | Soluble, but the surfactant component was salted out |
| 5% Sodium Formate | Soluble, but a paste rather than the sought gel was formed |

It is conclusively evident from these data, that the range of 1–4% is indeed critical to the formulation of this product. The only salt that was soluble in a concentration of 5% or greater was sodium borate decahydrate, which was soluble up to 8%. However, the following data were recorded for these borate containing products.

| Borate Concentration | pH | Hardness | Dropping point (°F.) |
|---|---|---|---|
| 0% | 9.36 | 54 | 123.4 |
| 2% | 9.35 | 110 | 127.1 |
| 5% | 9.35 | 90 | 133.0 |
| 8% | 9.211 | 68 | 134.3 |

It is shown by the above data that even through the Sodium Borate Decahydrate is soluble above 4%, the resulting sticks are too hard, and not suitable in the practice of the present invention. The criterion for hardness is that the reading be no less than 110 units. This hardness correlates with data from consumer testing.

The products of the subject invention, as disclosed and claimed, constitute commercially significant improvements over products heretofore produced and sold in the market place.

Detergent builders can be added to the pre-spotter stick formulations. A general class of builders or chelants known as polyaminocarboxylic acids are useful for this function. Examples include sodium nitrillotriacetic acid and hydroxyethyldiaminotriacetic acid. Citric acid and its salts as well as polyacrylic acids can also be utilized for this purpose. The builder is included in the formulations in concentrations from 0.01–10%.

The utilization of particular salts in specific controlled concentrations, according to the teachings of this invention, is particularly efficacious when builders are incorporated into the formulation. without the addition of the salts of the invention, the builders have a tendency to crystallize in the matrix. In substituting a more soluble salt of the builder, such as substituting potassium citrate for sodium citrate, the properties of the stick are altered such that the matrix does not have the desired hardness and dropping point. However, the addition of a salt, in accordance with the method of the present invention, will give the desired product.

The products of the invention are waxy, greasy, translucent to opaque solids with a dropping point of 100° to 180° F., but preferably above 120° F.

A very extensive group of salts can be used in practicing the invention. These salts include the salts of both organic and inorganic acids. Examples are chloride, sulfate, carbonate, phosphate, bromide, formate, acetate, tartrate, borate, and metaborate as the anions, with the cations being sodium, potassium, calcium, lithium, magnesium, and aluminum. This list is meant to be representative and not to exclude other known salts.

Referring now more particularly to the surfactant system, in one preferred embodiment of the invention the surfactants include anionics, in particular, linear alkylbenzene sulfonates, for example, sodium dodecylbenzenesulfonate. These anionic surfactants function more effectively than do the non-ionics in removing soil and stain from cotton fabrics.

Preferred non-ionic surfactants include ethoxylated linear alcohols, ethoxylated alkylphenols (preferably $C_6$–$C_{12}$ alkylphenols), and polyethylene glycols.

Within the teachings of the invention, different surfactants may be substituted in the compositions. For example, surfactants of the nonionic type include ethoxylated linear alcohols, ethoxylated alkylphenols, and polyethylene glycols. Propylene glycol, including the mono, di, and tri analogs, may be used. Various types of stearic acids including single, double and triple pressed stearic acid are suitable. The enzymes used include protease, lipase and amylase, in a stabilized blend, or as unstabilized preparations with calcium salts added for stabilization.

The efficacy and effectiveness of the product has been conclusively demonstrated using test preparations, EMPA-116 (blood, milk, ink), EMPA-112 (cocoa, milk, sugar), and grass soils, on cotton. The swatches were washed in 150 ppm hardness water at 100° F., with 100 cycles per minute aggitation, and 1.5 g/l non-phosphate powdered commercial detergent The test swatches were then read on a Hunter Reflectometer, using the L scale, where L is an indication of lightness-darkness.

| PRODUCT | EMPA-112* (STAIN) | EMPA-116* (STAIN) | GRASS* (STAIN) |
|---|---|---|---|
| TIDE | 7.0 | 28.0 | 7.1 |

-continued

| PRODUCT | EMPA-112* (STAIN) | EMPA-116* (STAIN) | GRASS* (STAIN) |
|---|---|---|---|
| CLOROX-2 | 9.2 | 56.3 | 15.5 |
| SHOUT | 13.1 | 56.2 | 9.9 |
| PRODUCT OF THE INVENTION | 19.2 | 107.0 | 15.4 |

*% Remission = $\frac{\text{Final "L" Reading}}{\text{Initial "L" Reading}}$

The present invention constitutes formulations and methods of controlling the consistency of the solid formulations and the dropping point in spotting sticks. Current art teaches that there is a direct relationship between the dropping point and the hardness of the formulation. That is to say that if one raises the dropping point, the hardness increases. The present invention discloses a technique for raising the dropping point and simultaneously decreasing the hardness of the formulation, an effect which is contrary to what is normally observed in sodium stearate formulations.

A formulation and concentrational ranges in which borate salt is the parameter-regulating additive are set forth in the following table. The method of preparation is described in Example 5.

| | Conc. (parts by weight) | Operational Concentrational Ranges (parts by weight) |
|---|---|---|
| Stearic Acid | 9.4 | 5–10 |
| Dodecylbenzene Sulfonic Acid | 5.2 | 3–20 |
| Dipropylene Glycol | 3.7 | 2–6 |
| Propylene Glycol | 33.7 | 20–50 |
| Nonyl Phenol Ethoxylate | 14.9 | 5–30 |
| Linear Alcohol Ethoxylate | 14.9 | 5–30 |
| Polyethylene Glycol | 1.6 | |
| NaOH-50% | 3.7 | 2–5 |
| Enzyme | 5.0 | 2–10 |
| Sodium Borate Decahydrate | 2.9 | 2–4 |
| Fragrance | 0.02 | |
| Water | q.s. | |

EXAMPLE 5

The two surfactants and the glycols are heated to 150° F., with stirring, until solution takes place. The polyethylene glycol is added next, followed by a water solution containing the sodium borate. When solution has taken place, the sodium hydroxide and sulfonic acid are added. This is followed by addition of the stearic acid. When the stearic acid has dissolved, the temperature is lowered to approximately 130° F., and the enzyme is added with stirring. The resulting formulation is poured into the appropriate mold-like containers or formers.

Products produced in accordance with the invention are characterized by an ASTM penetrometer hardness of 3 to 30 mm (30 to 300 units) using the standard cone with no additional weight added.

What is claimed is:

1. In a laundry soil and stain remover composition in applicator stick form for application to fabric as an aid in laundering, said composition establishing a balance and functional optimization of the values of interrelated parameters including pH, drop point and hardness, and including a laundry enzyme operable digestively to attack and to eliminate grease and food-derived stains from fabrics, a surfactant, a bodying agent constituting a gelling carrier vehicle for said enzyme and said surfactant, said enzyme and said surfactant being intimately and uniformly dispersed throughout said carrier to provide a physically self-sustaining solid for direct positive application and material transfer to selectable zones of fabrics to be treated, prior to subjecting the fabrics to a laundering cycle, said composition having a pH in the range of about 9.3 to about 9.8, having a dropping point in the range of from about 100 degrees F. to about 140 degrees F., and melting in the range of 40 degrees C. (104 degrees F.) to 80 degrees C. (176 degrees F.) and having a hardness in the range of 3 mm to 30 mm measured using an ASTM standard needle with no weight added, and said composition being effective to enhance likelihood of effectively removing stains present in the fabrics, the improvement comprising a chemical agent incorporated into said stain removing composition for maintaining the dropping point of said composition in said 100° F. to 140° F. range, holding the pH in a range of said about 9.3 to about 9.8 to ensure effective enzyme activity, maintaining the hardness of said composition, in said 3–30 mm range, and the melting range from 40°–80° C., said chemical agent comprising a salt in a concentration of from about 1% to about 4% by weight in said composition, said salt being other than said surfactant and other than said bodying agent, and including a member selected from the group consisting of sulfate, carbonate, phosphate, bromide, formate, acetate, tartrate, borate, metaborate, and mixtures thereof as anions, and a member selected from the group consisting of sodium, potassium, calcium, lithium, magnesium, and aluminum, and mixtures thereof as cations.

2. The improvement as set forth in claim 1 wherein said bodying agent comprises sodium stearate generated in-situ within said composition, said bodying agent constituting a gelling carrier vehicle for said enzyme and for said surfactant.

3. The improvement as set forth in claim 1 and characterized in that said composition exhibits effectiveness for a soil and stain remover not only when applied immediately prior to laundering, but even though application of said composition to fabrics to be treated is made well in advance and as much as several days prior to laundering of the fabrics to which said composition is applied.

4. The composition as set forth in claim 1 wherein said surfactant includes a linear alkyl benzenesulfonate.

5. The composition as set forth in claim 1 wherein said surfactant comprises sodium dodecylbenzenesulfonate.

6. The composition as set forth in claim 1 wherein said surfactant includes linear alcohol ethoxylates, alkylphenol ethoxylates and polyethylene glycols.

7. The composition as set forth in claim 1 wherein said carrier vehicle comprises sodium stearate.

8. In the formulation and compounding of a laundry soil and stain remover composition and including the steps of intimately distributing a surfactant and grease and food stain digesting enzyme throughout a gelling carrier vehicle to provide a physically self-sustaining solid product, the method of maintaining the dropping point of said composition above about 120° F., the pH, in the range of about 9.3 to 9.8, and the hardness in the range of 3 mm to 30 mm measured using an ASTM standard needle with no weight added, said method including the step of dispersing throughout said composition a chemical agent for establishing a balance and functional optimization of the hardness, said agent comprising a salt in a concentration of from about 1% to about 4% by weight in said composition, said salt being other than said surfactant and including a member selected from the group consisting of tartrate, borate, and metaborate, and mixtures thereof as anions, and a member selected from the group consisting of sodium, potassium, calcium, lithium, magnesium, aluminum, and mixtures thereof as cations.

* * * * *

UNITED STATES PATENT AND TRADEMARK OFFICE

CERTIFICATE OF CORRECTION

PATENT NO. : 4,842,762

DATED : June 27, 1989

INVENTOR(S) : John Stephen Sabol, Jr. and Wayne Albert Kester

It is certified that error appears in the above-identified patent and that said Letters Patent is hereby corrected as shown below:

Column 5, above the chart that starts with Ingredient, insert, centered on the page, --Example I--, and below Example I, insert centered on the page --(Typical Sodium Stearate Formulation)--.

Column 8, line 61, proceeding the word detergent, insert --(e.g., Tide).--.

Column 11, line 9, preceding the word hardness, insert --values of interrelated parameters including pH, drop point and --.

Signed and Sealed this

Twenty-first Day of May, 1991

*Attest:*

HARRY F. MANBECK, JR.

*Attesting Officer*

*Commissioner of Patents and Trademarks*